US008231418B2

(12) United States Patent
Okabe et al.

(10) Patent No.: US 8,231,418 B2
(45) Date of Patent: Jul. 31, 2012

(54) MARINE VESSEL PROPULSION UNIT

(75) Inventors: Yoshihiko Okabe, Shizuoka (JP); Daisuke Nakamura, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 257 days.

(21) Appl. No.: 12/697,404

(22) Filed: Feb. 1, 2010

(65) Prior Publication Data

US 2010/0197180 A1 Aug. 5, 2010

(30) Foreign Application Priority Data

Feb. 2, 2009 (JP) ..... 2009-021531

(51) Int. Cl.
*B63H 20/14* (2006.01)

(52) U.S. Cl. ..... 440/75

(58) Field of Classification Search ..... 440/75
See application file for complete search history.

(56) References Cited

U.S. PATENT DOCUMENTS 4,099,478 A * 7/1978 Alexander, Jr. ..... 440/6
5,236,380 A * 8/1993 Schueller et al. ..... 440/76
5,601,464 A * 2/1997 Ogino et al. ..... 440/75
5,795,200 A * 8/1998 Larkin ..... 440/81
6,435,923 B1 * 8/2002 Ferguson ..... 440/75
7,168,997 B2 * 1/2007 Ohtsuki ..... 440/75

FOREIGN PATENT DOCUMENTS

JP 55-19681 A 2/1980

* cited by examiner

*Primary Examiner* — Stephen Avila

(74) *Attorney, Agent, or Firm* — Keating & Bennett, LLP

(57) ABSTRACT

A marine vessel propulsion unit includes an engine, a drive shaft, a single propeller shaft, a single propeller, and a planetary gear mechanism. The drive shaft is arranged to extend vertically. The propeller shaft is arranged to extend in a direction intersecting the drive shaft. The rotation of the engine is transmitted to the propeller shaft via the drive shaft. The propeller is arranged to rotate together with the propeller shaft. The planetary gear mechanism is arranged at the front relative to the drive shaft and coaxial to a central rotation axis of the propeller shaft. The planetary gear mechanism is arranged to decelerate the rotation from the drive shaft and transmit the decelerated rotation toward the propeller shaft.

14 Claims, 7 Drawing Sheets

MARINE VESSEL PROPULSION UNIT

BACKGROUND OF THE INVENTION

1. Field of the Invention

The present invention relates to a marine vessel propulsion unit.

2. Description of the Related Art

A prior art marine vessel propulsion unit is disclosed in Japanese Published Unexamined Patent Application No. Sho 55-19681. The marine vessel propulsion unit according to this prior art is an outboard motor. The outboard motor includes an engine, a drive shaft, a propeller shaft, a propeller, a planetary gear mechanism, and a brake lever. The planetary gear mechanism includes a ring gear fixed by operation of the brake lever, a sun gear into which rotation from the drive shaft is input, a carrier from which the rotation input into the sun gear is output, and a plurality of planetary gears arranged between the ring gear and the sun gear.

The outboard motor is arranged such that a driving force of the engine is transmitted from the drive shaft to the propeller shaft via the planetary gear mechanism by operation of the brake lever in a state where a shift position is at a neutral position. Also, the outboard motor is arranged such that the driving force of the engine is transmitted from the drive shaft to the propeller shaft without transmission via the planetary gear mechanism when the shift position is at a forward drive position or a reverse drive position. The planetary gear mechanism is used when the outboard motor drives a hull forward at a low speed, for example, to perform trawling. On the other hand, when the outboard motor drives the hull forward or in reverse at an ordinary speed (when ordinary running of the hull is performed), the planetary gear mechanism is not used.

SUMMARY OF THE INVENTION

The inventors of preferred embodiments of the present invention described and claimed in the present application conducted an extensive study and research regarding a marine vessel propulsion unit, such as the one described above, and in doing so, discovered and first recognized new unique challenges and previously unrecognized possibilities for improvements as described in greater detail below.

That is, when the driving force of the engine is transmitted to the propeller shaft via the planetary gear mechanism, a torque is amplified by the planetary gear mechanism and thus, a comparatively large torque is transmitted to the propeller. On the other hand, when the driving force of the engine is transmitted to the propeller shaft without transmission via the planetary gear mechanism, the torque transmitted to the propeller is small as compared to the above case. Thus, with the outboard motor according to the prior art, a large torque cannot be transmitted readily to the propeller when ordinary running of the hull is performed.

In order to overcome the previously unrecognized and unsolved problems described above, a preferred embodiment of the present invention provides a marine vessel propulsion unit arranged to apply a propulsive force to a hull. The marine vessel propulsion unit includes an engine, a drive shaft, a single propeller shaft, a single propeller, and a planetary gear mechanism. The drive shaft is arranged to extend vertically. The propeller shaft is arranged to extend in a direction intersecting the drive shaft. A rotation of the engine is transmitted to the propeller shaft via the drive shaft. The propeller is arranged to rotate together with the propeller shaft. The planetary gear mechanism is arranged at a front relative to the drive shaft and coaxial to a central rotation axis of the propeller shaft. The planetary gear mechanism is arranged to decelerate a rotation from the drive shaft and transmit a decelerated rotation toward the propeller shaft. The planetary gear mechanism includes a sun gear fixed in a non-rotating state, a ring gear into which a rotation from the drive shaft is input, a plurality of planetary gears arranged between the sun gear and the ring gear, and a carrier arranged to hold the plurality of planetary gears. The planetary gear mechanism is arranged such that a rotation of the carrier is output to the propeller shaft.

By this arrangement, when the marine vessel propulsion unit drives the hull forward, the rotation of the drive shaft is transmitted to the propeller shaft via the planetary gear mechanism. More specifically, the rotation from the drive shaft is input into the ring gear. The sun gear is fixed in the non-rotating state, and thus the rotation input into the ring gear is output from the carrier via the planetary gears. The rotation of the drive shaft is thereby transmitted to the propeller shaft via the planetary gear mechanism. The planetary gear mechanism decelerates the input rotation and outputs a decelerated rotation. Further, the planetary gear mechanism amplifies the input torque and outputs an amplified torque. Thus, by the rotation of the drive shaft being transmitted to the propeller shaft via the planetary gear mechanism, a large torque is transmitted to the propeller. A large torque is thereby transmitted to the propeller during ordinary running of the hull including during driving of the hull forward at high speed and during increasing of the forward drive speed.

Also, the plurality of planetary gears may be aligned in a single row around the sun gear such that each of the planetary gears is engaged with both the ring gear and the sun gear.

The marine vessel propulsion unit may further include a clutch. The clutch may be arranged to switch a rotation direction of the propeller shaft to a forward drive direction or a reverse drive direction, and be arranged to transmit the rotation of the carrier to the propeller shaft when the hull is driven forward.

The clutch may include first and second members. In this case, the first member may be arranged to rotate together with the carrier. Also, the second member may be arranged to rotate together with the propeller shaft and be arranged to selectively transmit the rotation of a first member to the propeller shaft.

Also, the carrier may include a tubular portion including an inner peripheral surface that engages with an outer peripheral surface of the first member. In this case, the carrier may be arranged to rotate together with the first member by an engagement of the outer peripheral surface of the first member with the inner peripheral surface of the tubular portion.

The marine vessel propulsion unit may further include a reduction mechanism arranged to decelerate a rotation from the drive shaft and transmit a decelerated rotation to the ring gear. In this case, the reduction mechanism may include an output gear, a first bevel gear, and a transmission member. The output gear may be arranged to rotate together with the drive shaft. The first bevel gear may be engaged with the output gear and be arranged to rotate in a first direction about the central rotation axis of the propeller shaft. The transmission member may be arranged to rotate together with the first bevel gear and be arranged to transmit a rotation of the first bevel gear to the ring gear.

Also, the transmission member may be arranged to surround at least a portion of the carrier.

The marine vessel propulsion unit may further include a reduction mechanism arranged to decelerate a rotation from the drive shaft and transmit a decelerated rotation to the ring gear. In this case, the reduction mechanism may include an output gear, a first bevel gear, a transmission member, and a second bevel gear. The output gear may be arranged to rotate together with the drive shaft. The first bevel gear may be engaged with the output gear and be arranged to rotate in a first direction about the central rotation axis of the propeller shaft. The transmission member may be arranged to rotate together with the first bevel gear and be arranged to transmit a rotation of the first bevel gear to the ring gear. The second bevel gear may be engaged with the output gear and be arranged to rotate about the central rotation axis of the propeller shaft in a second direction, which is an opposite direction with respect to the first direction. The clutch may be arranged to be connected to the second bevel gear to cause the propeller shaft to rotate in the reverse drive direction.

The marine vessel propulsion unit may further include a housing arranged to house the planetary gear mechanism. In this case, the sun gear may be provided at the front relative to the ring gear and may include a flange portion arranged to engage with the housing.

Other elements, features, steps, characteristics and advantages of the present invention will become more apparent from the following detailed description of the preferred embodiments with reference to the attached drawings.

DETAILED DESCRIPTION OF PREFERRED EMBODIMENTS

First, an arrangement of an outboard motor 3 equipped in a marine vessel 1 according to a preferred embodiment of the present invention shall be described with reference to FIG. 1 to FIG. 5. FWD in the figures indicates a forward drive direction of the marine vessel 1, and BWD in the figures indicates a reverse drive direction of the marine vessel 1.

Figure 1:
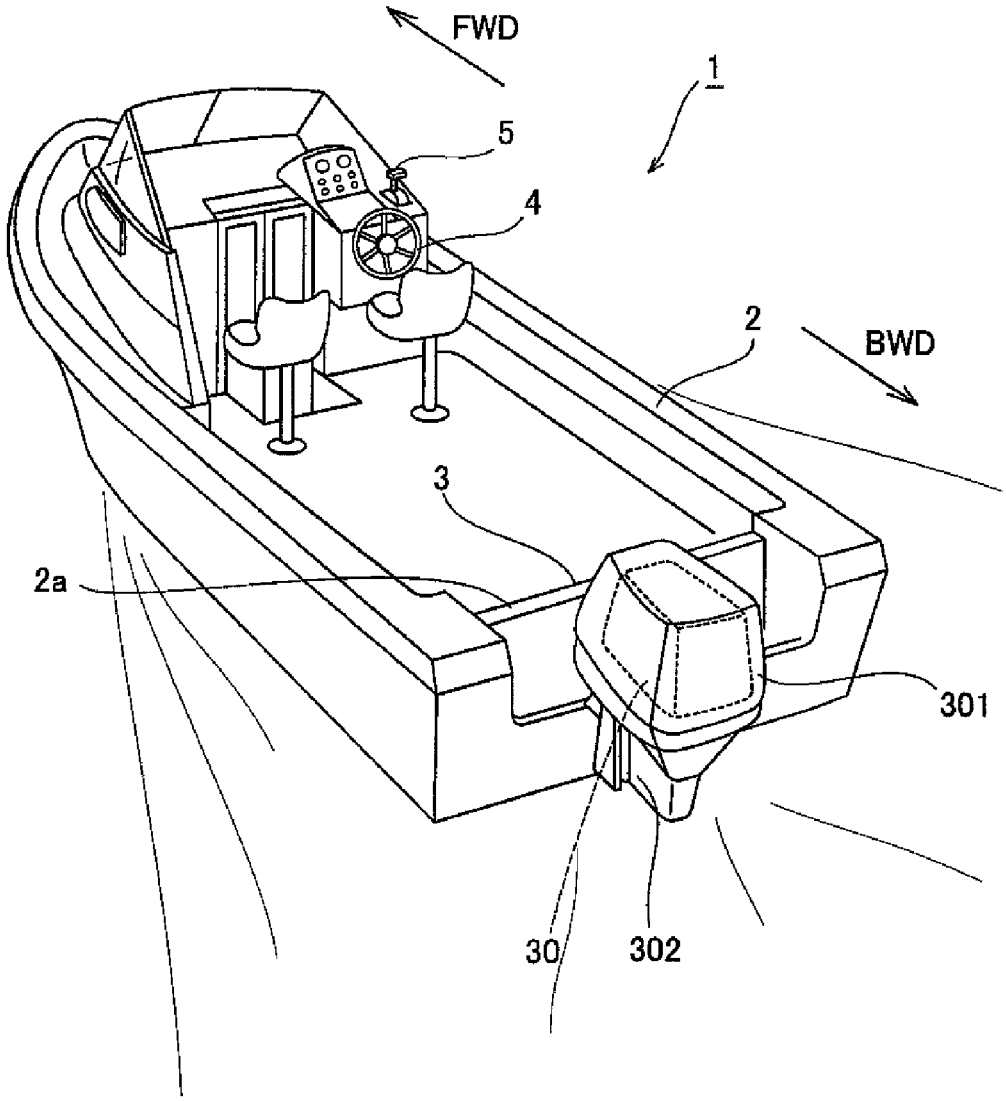
FIG. 1 is a perspective view of a marine vessel equipped with an outboard motor according to a preferred embodiment of the present invention.

FIG. 1 is a perspective view of the marine vessel 1 equipped with the outboard motor 3 according to a preferred embodiment of the present invention.

The marine vessel 1 includes a hull 2 floating on a water surface, an outboard motor 3 attached to a rear portion of the hull 2, a steering portion 4 for steering the hull 2, and a control lever 5 arranged in a vicinity of the steering portion 4. The outboard motor 3 is attached to a transom board 2*a* of the hull 2. The hull 2 is propelled by the outboard motor 3. Also, forward drive and reverse drive of the hull 2 are switched by the control lever 5. The outboard motor 3 is an example of a "marine vessel propulsion unit" according to a preferred embodiment of the present invention.

Figure 2:
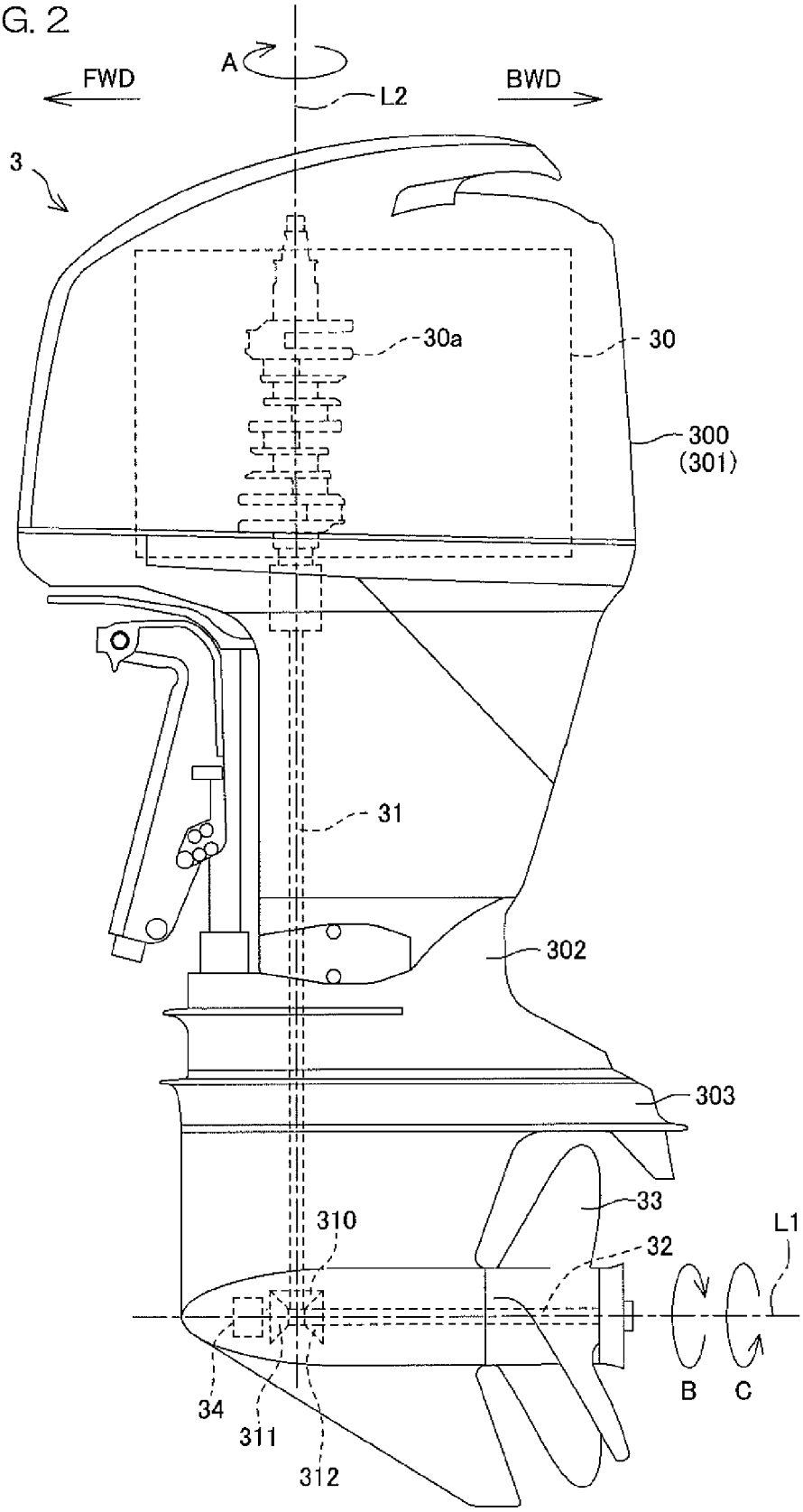
FIG. 2 is a sectional view for describing an arrangement of the outboard motor according to a preferred embodiment of the present invention.

FIG. 2 is a sectional view for describing an arrangement of the outboard motor 3 according to a preferred embodiment of the present invention.

The outboard motor 3 includes an engine 30, a drive shaft 31, a single propeller shaft 32, a single propeller 33, and a planetary gear mechanism 34. The drive shaft 31 extends vertically below the engine 30. The drive shaft 31 is rotated by the engine 30. Also, the propeller shaft 32 extends in a front/rear direction. The propeller shaft 32 is arranged to rotate about a central rotation axis L1. The planetary gear mechanism 34 is arranged at the front (in the FWD arrow direction) relative to the drive shaft 31 and coaxial to the central rotation axis L1 of the propeller shaft 32. Also, the propeller 33 is attached to a rear end portion of the propeller shaft 32. The propeller 33 is arranged to rotate together with the propeller shaft 32 in a B direction and a C direction about the central rotation axis L1. By the propeller 33 being rotated in the B direction, a propulsive force that drives the hull 2 forward is generated. Also, by the propeller 33 being rotated in the C direction, a propulsive force that drives the hull 2 in reverse is generated.

Also, the engine 30 is housed in an engine cover 301. The engine 30 includes a crankshaft 30*a*. The engine 30 is arranged such that the crankshaft 30*a* extends along an axis L2 (for example, a vertical axis). The crankshaft 30*a* is arranged to rotate in an A direction about the axis L2. The A direction is, for example, a clockwise direction as viewed from above. A lower end portion of the crankshaft 30*a* is connected to an upper end portion of the drive shaft 31. The drive shaft 31 is arranged to rotate in the A direction together with the crankshaft 30*a*. The drive shaft 31 is arranged along an axis L2 below the engine 30. The drive shaft 31 is housed in an upper case 302 and a lower case 303. The lower case 303 is an example of a "housing" according to a preferred embodiment of the present invention.

Figure 3:
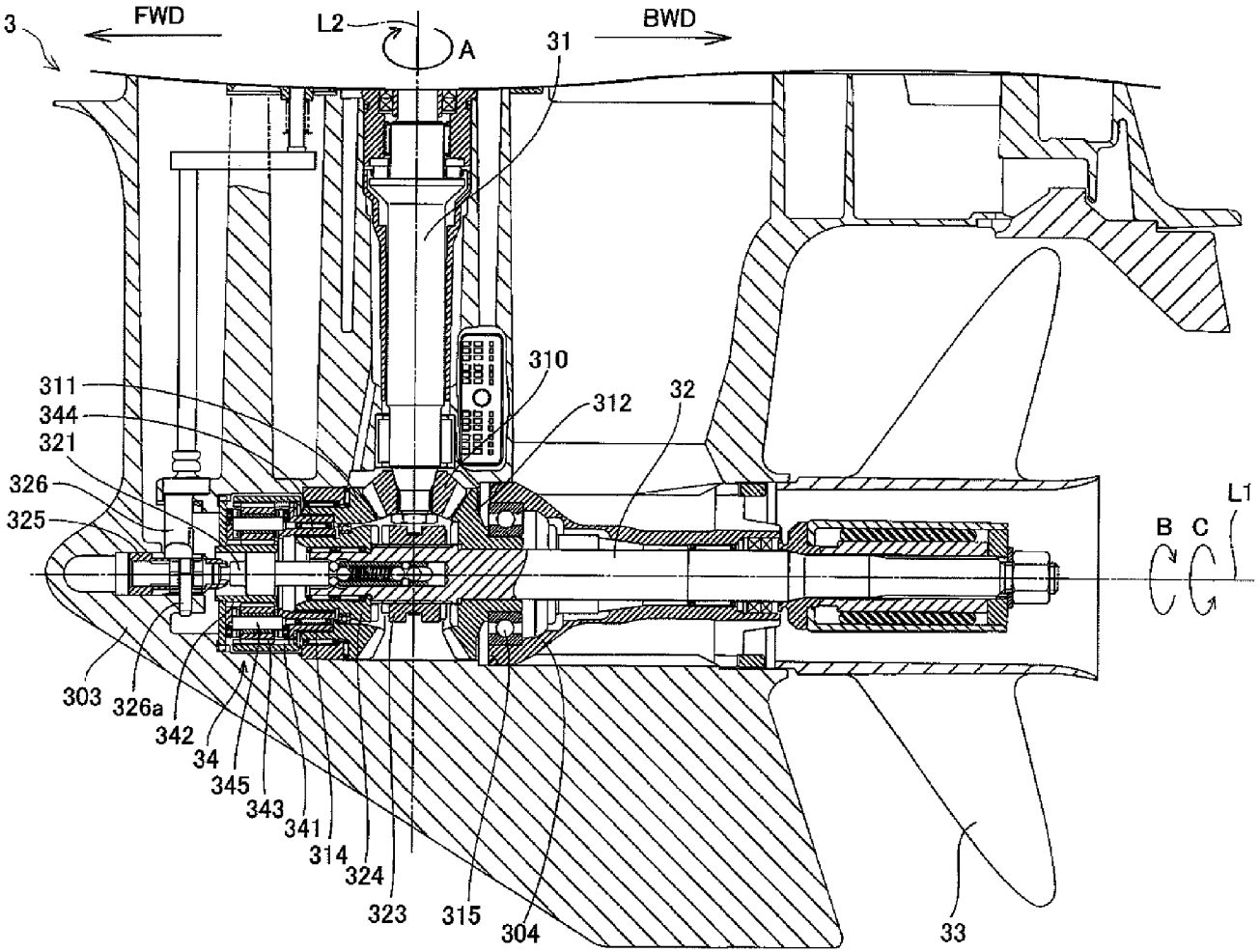
FIG. 3 is a sectional view for describing an arrangement inside a lower case of the outboard motor according to a preferred embodiment of the present invention.

FIG. 3 is a sectional view for describing an arrangement inside the lower case 303 of the outboard motor 3 according to a preferred embodiment of the present invention.

The outboard motor 3 includes a bevel gear 310, a front bevel gear 311, and a rear bevel gear 312. The bevel gear 310 is an example of a "reduction mechanism" and an "output gear" according to a preferred embodiment of the present invention. Also, the front bevel gear 311 is an example of the "reduction mechanism" and a "first bevel gear" according to a preferred embodiment of the present invention. Also, the rear bevel gear 312 is an example of the "reduction mechanism" and a "second bevel gear" according to a preferred embodiment of the present invention.

The bevel gear 310, the front bevel gear 311, and the rear bevel gear 312 have tubular shapes, respectively. A lower end portion of the drive shaft 31 is fitted into an inner periphery of the bevel gear 310. The bevel gear 310 is attached to the lower end portion of the drive shaft 31 so as to rotate together with the drive shaft 31 in the A direction. Also, the front bevel gear 311 and the rear bevel gear 312 are arranged along the central rotation axis L1 and across an interval in a front/rear direction. The bevel gear 310 is engaged with the front bevel gear 311 and the rear bevel gear 312. More specifically, the bevel gear 310 is engaged with a gear portion 311*a* (see FIG. 4) of the front bevel gear 311 and a gear portion 312*a* (see FIG. 4) of the rear bevel gear 312.

The front bevel gear 311 is arranged to rotate in the B direction about the central rotation axis L1 of the propeller shaft 32 with the rotation of the bevel gear 310 in the A direction. Also, the rear bevel gear 312 is arranged to rotate in the C direction, which is the opposite direction with respect to the B direction, about the central rotation axis L1 of the propeller shaft 32 with the rotation of the bevel gear 310 in the A direction. The B direction is, for example, the clockwise direction when the propeller shaft 32 is viewed from the rear side (from the BWD arrow direction side). Also, the C direction is, for example, the counterclockwise direction when the propeller shaft 32 is viewed from the rear side. The B direction is an example of a "first direction" according to a preferred embodiment of the present invention and the C direction is an example of a "second direction" according to a preferred embodiment of the present invention.

A gear ratio of the bevel gear 310 to the front bevel gear 311 is, for example, approximately 1.75. The rotation of the bevel gear 310 is thus decelerated and transmitted to the front bevel gear 311. Also, the gear ratio of the bevel gear 310 to the rear bevel gear 312 is equal to, for example, approximately 1.75 of the gear ratio of the bevel gear 310 to the front bevel gear 311. The rotation of the bevel gear 310 is thus decelerated and transmitted to the rear bevel gear 312.

Figure 4:
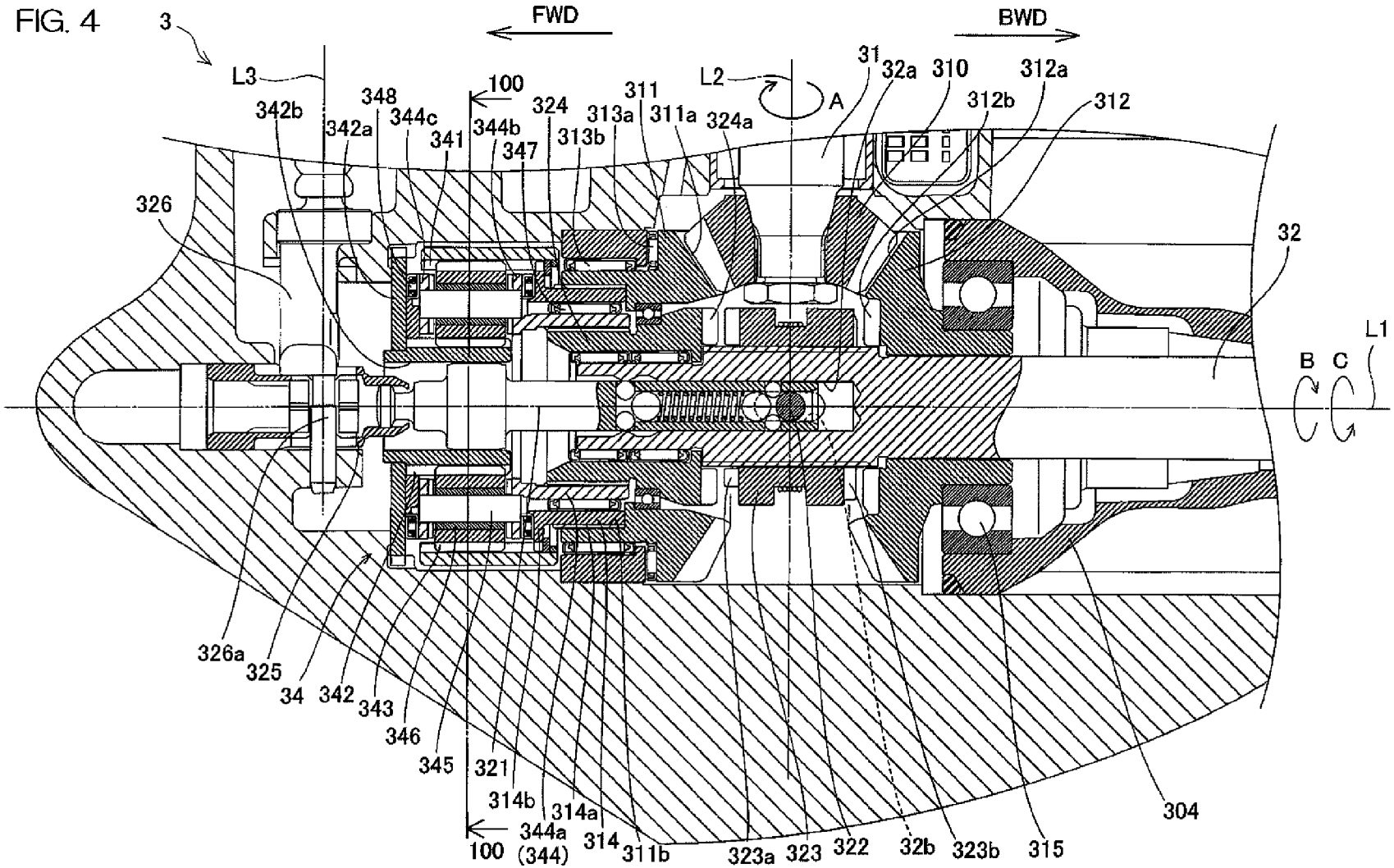
FIG. 4 is a sectional view for describing an arrangement of a periphery of a planetary gear mechanism of the outboard motor according to a preferred embodiment of the present invention.

FIG. 4 is a sectional view for describing an arrangement of a periphery of the planetary gear mechanism 34 of the outboard motor 3 according to a preferred embodiment of the present invention.

The front bevel gear 311 is supported by a thrust bearing 313*a* that receives a forward-directed load and a bearing 313*b* that receives a load in a radial direction. Also, the front bevel gear 311 includes a spline groove 311*b* provided at a front side portion of an inner peripheral surface of the front bevel gear 311. The spline groove 311*b* is engaged with a spline groove 314*a* provided in an outer peripheral portion of a tubular transmission member 314. By the engagement of the two spline grooves 311*b* and 314*b*, the transmission member 314 rotates together with the front bevel gear 311. The transmission member 314 is an example of the "reduction mechanism" and a "transmission member" according to a preferred embodiment of the present invention.

The rear bevel gear 312 is fitted in an inner periphery of a bearing 315. The bearing 315 is fixed to the lower case 303 via the housing 304. The bearing 315 is arranged to support the rear bevel gear 312 with stability even when the rear bevel gear 312 is rotated about the central rotation axis L1. Also, a front end portion of the propeller shaft 32 passes through an inner periphery of the rear bevel gear 312 and reaches an inner side of the front bevel gear 311. The propeller shaft 32 is arranged to idle with respect to the front bevel gear 311 and the rear bevel gear 312.

The propeller shaft 32 includes an insertion hole 32*a* extending rearward along the central rotation axis L1 from a front end of the propeller shaft 32, and a through hole 32*b* passing through the propeller shaft 32 in a direction perpendicular or substantially perpendicular to the central rotation axis L1 and intersecting the insertion hole 32*a*. A portion of a cylindrical slide member 321 is inserted into the insertion hole 32*a* from the front. The slide member 321 is arranged to slide to the front and rear with respect to the insertion hole 32*a*. Also, the through hole 32*b* has a slot shape that is long in the front/rear direction.

Also, a rear end portion of the slide member 321 is arranged at a position at which the insertion hole 32*a* and the through hole 32*b* intersect. A bar-shaped joint member 322 is fixed to a rear end portion of the slide member 321 so as to be perpendicular or substantially perpendicular to the slide member 321 and the propeller shaft 32. Although unillustrated, respective end portions of the joint member 322 protrude from an outer peripheral surface of the propeller shaft 32 through the through hole 32*b*. When the slide member 321 slides to the front or rear, the joint member 322 slides to the front or rear together with the slide member 321.

Also, the outboard motor 3 includes a tubular first member 324 arranged at the inner side of the front bevel gear 311 and a tubular dog clutch 323 arranged to switch the rotation direction of the propeller shaft 32. The first member 324 is an example of a "clutch" and a "first member" according to a preferred embodiment of the present invention. Also, the dog clutch 323 is an example of the "clutch" and a "second member" according to a preferred embodiment of the present invention. The dog clutch 323 is arranged between the first member 324 and the rear bevel gear 312. The front end portion of the propeller shaft 32 is inserted through an inner periphery of the dog clutch 323. Although unillustrated, the dog clutch 323 is fixed to both end portions of the joint member 322 at a periphery of the propeller shaft 32. Also, as shall be described below, the rotation of the front bevel gear 311 is transmitted from the planetary gear mechanism 34 to the first member 324. The planetary gear mechanism 34 is arranged to rotate the first member 324 in the B direction (forward drive direction).

An inner peripheral surface of the dog clutch 323 is spline-engaged with the outer peripheral surface of the propeller shaft 32. The dog clutch 323 is arranged to rotate about the central rotation axis L1 together with the propeller shaft 32 and the joint member 322. Further, the dog clutch 323 is arranged to slide to the front and rear with respect to the propeller shaft 32. The dog clutch 323 slides to the front and rear with respect to the propeller shaft 32 between a forward drive position where it engages with the first member 324 and a reverse drive position where it engages with the rear bevel gear 312. The forward drive position is a position at which a front dog 323*a* arranged at an end portion of the dog clutch 323 in the FWD arrow direction side engages with a dog portion 324*a* of the first member 324. Also, the reverse drive position is a position at which a rear dog 323*b* arranged at an end portion of the dog clutch 323 in the BWD arrow direction side engages with a dog portion 312*b* of the rear bevel gear 312.

When the dog clutch 323 is arranged at the forward drive position, the rotation of the first member 324 in the B direction (forward drive direction) is transmitted to the dog clutch 323 by the engagement of the dog clutch 323 and the first member 324. The propeller shaft 32 is thereby rotated in the B direction. When the dog clutch 323 is arranged at the reverse drive position, the rotation of the rear bevel gear 312 in the C direction (reverse drive direction) is transmitted to the dog clutch 323 by the engagement of the dog clutch 323 and the rear bevel gear 312. The propeller shaft 32 is thereby rotated in the C direction. The rotation direction of the propeller shaft 32 is thus switched by the dog clutch 323 being moved to the front and rear.

Also, when the dog clutch 323 is arranged at an intermediate position between the forward drive position and the reverse drive position, the dog clutch 323 is separated from the first member 324 and the rear bevel gear 312. Thus, when the dog clutch 323 is arranged at an intermediate position, the rotations of the first member 324 and the rear bevel gear 312 are not transmitted to the propeller shaft 32. The dog clutch 323 is thus arranged to engage and disengage with respect to each of the first member 324 and the rear bevel gear 312.

Also, the dog clutch 323 is slid to the front and rear with respect to the propeller shaft 32 between the forward drive position and the reverse drive position by the slide member 321 being moved to the front and rear. More specifically, a front end portion of the slide member 321 is engaged with a joint member 325. The joint member 325 is engaged with a protruding portion 326*a* provided at a lower end portion of a forward-reverse switching lever 326. The protruding portion 326*a* is moved to the front and rear by the forward-reverse switching lever 326 being rotated about an axis L3. The joint member 325 and the slide member 321 are moved to the front and rear by the protruding portion 326*a* being moved to the front and rear. The dog clutch 323 is thus slid to the front and rear with respect to the propeller shaft 32 between the forward drive position and the reverse drive position by the forward-reverse switching lever 326 being rotated about the axis L3. The dog clutch 323 is thereby engaged and disengaged with respect to each of the first member 324 and the rear bevel gear 312.

Figure 5:
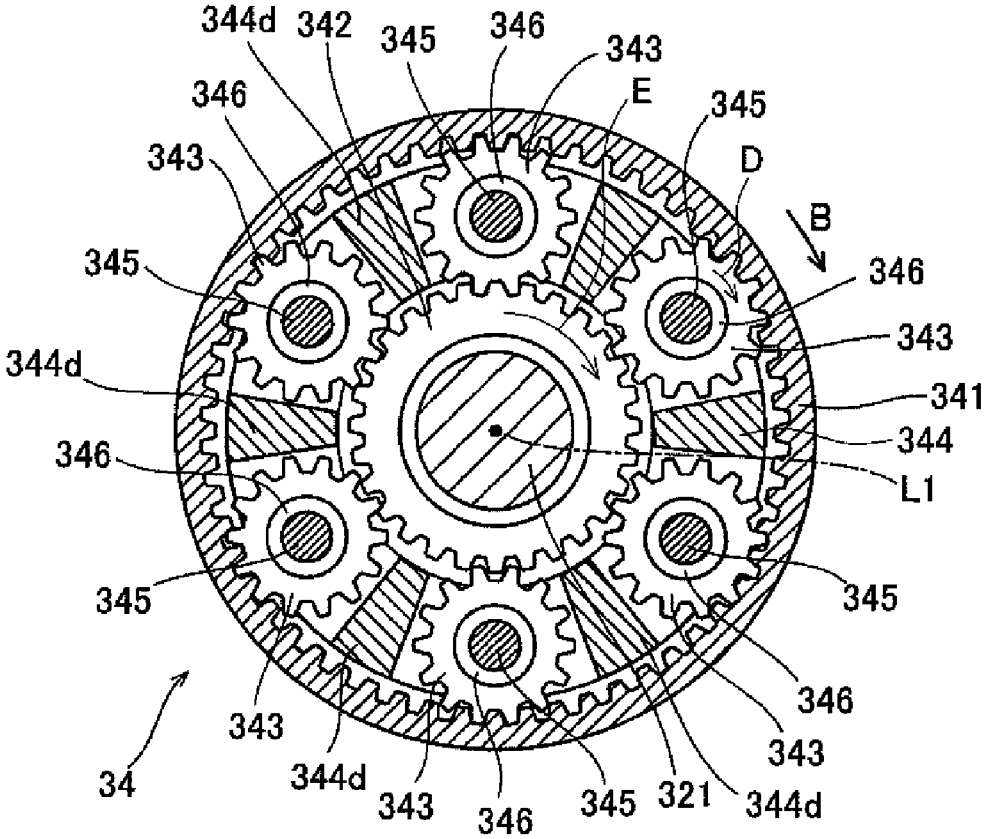
FIG. 5 is a sectional view taken along line 100-100 shown in FIG. 4.

FIG. 5 is a sectional view taken along line 100-100 shown in FIG. 4. The planetary gear mechanism 34 shall now be described specifically with reference to FIG. 4 and FIG. 5.

As shown in FIG. 4, the planetary gear mechanism 34 is housed in the lower case 303. The planetary gear mechanism 34 includes a ring gear 341 as an input member, a carrier 344 as an output member, a sun gear 342 as a fixed member, and a plurality (for example, six) of planetary gears 343. As shown in FIG. 5, the ring gear 341 surrounds the sun gear 342. The respective planetary gears 343 are arranged between the ring gear 341 and the sun gear 342. The respective planetary gears 343 are engaged with both the ring gear 341 and the sun gear 342. The respective planetary gears 343 are rotatably held by the carrier 344. The six planetary gears 343 are aligned in a single row around the sun gear 342. The planetary gear mechanism 34 is thus a so-called single pinion type planetary gear mechanism.

Also, as shown in FIG. 4, the ring gear 341 is engaged with the transmission member 314. More specifically, the transmission member 314 includes a flange portion 314*b* provided at a front end portion of the transmission member 314. The flange portion 314*b* is arranged at the inner side of the ring gear 341. An outer peripheral portion of the flange portion 314*b* is engaged with an inner periphery of the ring gear 341. The rotation from the engine 30 is input into the ring gear 341 via the transmission member 314. Also, the rotation input into the ring gear 341 is output from the carrier 344 via the respective planetary gears 343.

Also, as shown in FIG. 4, the sun gear 342 includes a flange portion 342*a* provided at a front end portion of the sun gear 342. The flange portion 342*a* is arranged to extend in a direction perpendicular or substantially perpendicular to the central rotation axis L1. The flange portion 342*a* is provided at the front relative to the ring gear 341. An outer peripheral portion of the flange portion 342*a* is engaged with the lower case 303. By the engagement of the flange portion 342*a* and the lower case 303, the sun gear 342 is fixed in a non-rotating state with respect to the lower case 303.

Also, the sun gear 342 includes an opening 342*b* extending in the front/rear direction along the central rotation axis L1. The slide member 321 is inserted in the opening 342*b*. The slide member 321 is arranged to rotate in the B direction and the C direction with respect to the opening 342*b*. Further, the slide member 321 is arranged to move to the front and rear with respect to the opening 342*b*.

Also, as shown in FIG. 5, each planetary gear 343 has a tubular shape, for example. Six axial members 345, for example, are respectively inserted in inner peripheries of the six planetary gears 343. Each planetary gear 343 is supported by the corresponding axial member 345 via a bushing 346. Each axial member 345 is fixed to the carrier 344. Each planetary gear 343 is thus supported by the carrier 344 via the corresponding axial member 345 and bushing 346. Each planetary gear 343 is arranged to rotate in a D direction (forward drive direction) about the corresponding axial member 345.

Also, the carrier 344 includes a tubular portion 344*a* (see FIG. 4), two flange portions 344*b* and 344*c* (see FIG. 4), and a plurality of column portions 344*d* (see FIG. 5). As shown in FIG. 4, the tubular portion 344*a* is arranged so as to surround the central rotation axis L1. A large portion of the tubular portion 344*a* is surrounded by the transmission member 314. The transmission member 314 is supported by the tubular portion 344*a* via a bearing 347. Also, the tubular portion 344*a* surrounds a portion of the first member 324 at an inner side of the transmission member 314. An inner peripheral surface of the tubular portion 344*a* is preferably spline-engaged with an outer peripheral surface of the first member 324. The first member 324 is thus rotated together with the tubular portion 344*a*.

Also, as shown in FIG. 4, the two flange portions 344*b* and 344*c* are arranged in front of the tubular portion 344*a*. The two flange portions 344*b* and 344*c* oppose each other in parallel or substantially in parallel across an interval in the front/rear direction. Although unillustrated, the two flange portions 344*b* and 344*c* are joined by the plurality of column portions 344*d*. The flange portion 344*b* extends outward from a front end portion of the tubular portion 344*a*. Also, the flange portion 344*c* is supported from the front by the flange portion 342*a* of the sun gear 342 via a thrust bearing 348. Movement of the carrier 344 to the front is restricted thereby.

Also, as shown in FIG. 5, the plurality of column portions 344*d* are preferably arranged at spaced intervals in a circumferential direction. Each planetary gear 343 is arranged between the column portions 344*d* that are adjacent in the circumferential direction. Also, as shown in FIG. 4, one end portion and the other end portion of each axial member 345 are fixed to the two flange portions 344*b* and 344*c*, respectively. The carrier 344 is thus arranged to rotate about the central rotation axis L1 together with the six planetary gears 343 and the axial member 345, for example.

The rotation of the front bevel gear 311 in the B direction (forward drive direction) is transmitted to the ring gear 341 via the transmission member 314. The ring gear 341 is thereby rotated in the B direction. Also, by the ring gear 341 being rotated in the Bdirection, each planetary gear 343 rotates (revolves) in an E direction (forward drive direction) about the central rotation axis L1 and around the sun gear 342 while rotating (auto-rotating) in the D direction (forward drive direction) about the corresponding axial member 345. The six axial members 345 and the carrier 344 are thereby rotated in the E direction. Then, the rotation of the carrier 344 is transmitted to the first member 324 and the first member 324 is rotated in the Bdirection. The rotation input into the ring gear 341 is thereby output from the carrier 344. Also, in the process of transmission of the rotation input into the ring gear 341 to the carrier 344, the rotation is decelerated. A so-called single pinion type planetary gear mechanism, arranged such that the rotation input into a ring gear is output from a carrier, has a speed reduction ratio, for example, of not less than approximately 1.20 and not more than approximately 1.80. The planetary gear mechanism 34 is arranged such that the speed reduction ratio is, for example, approximately 1.55.

Figure 6:
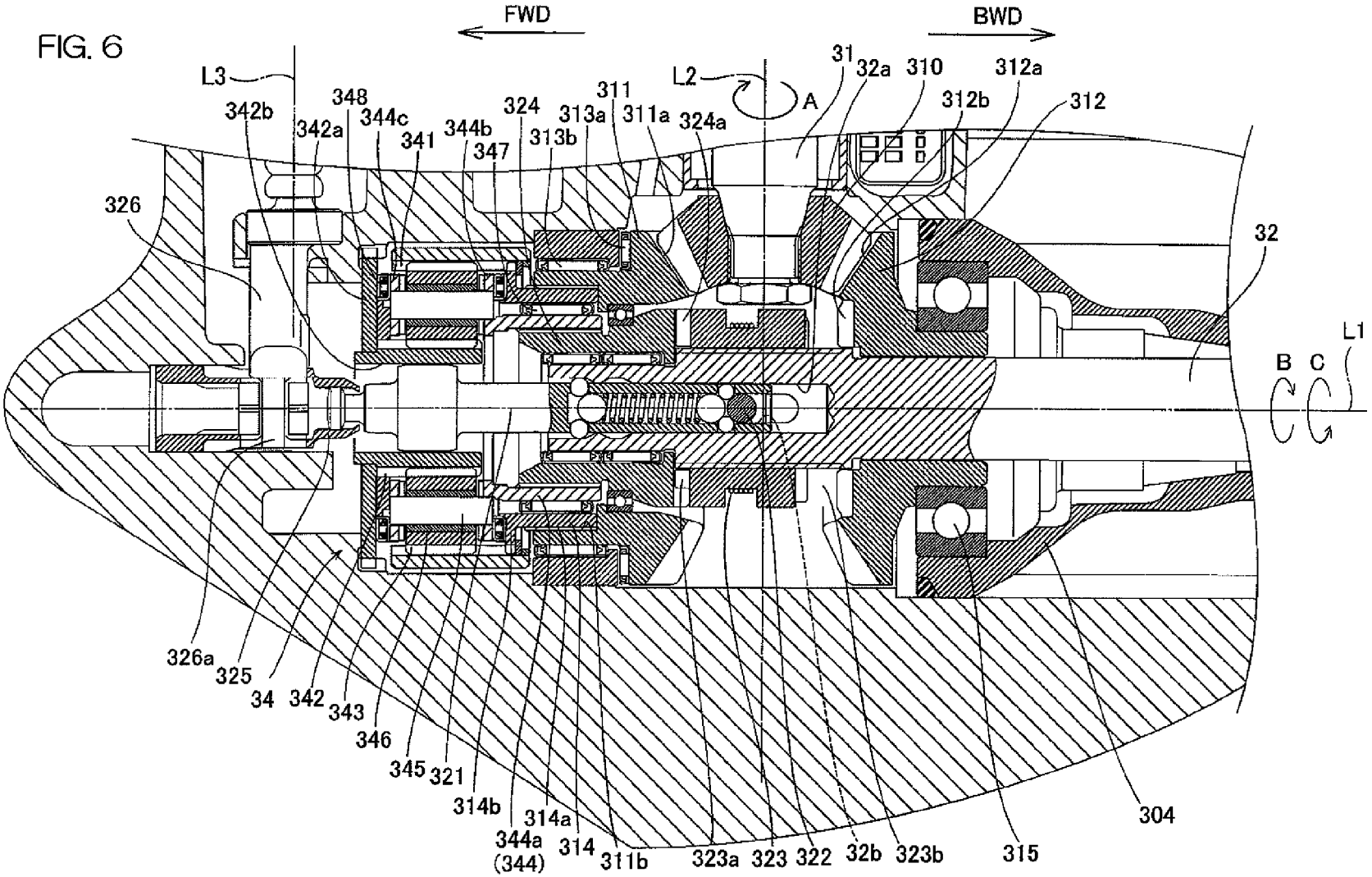
FIG. 6 is a sectional view showing a state of the periphery of the planetary gear mechanism when a hull is driven forward by the outboard motor according to a preferred embodiment of the present invention.
Figure 7:
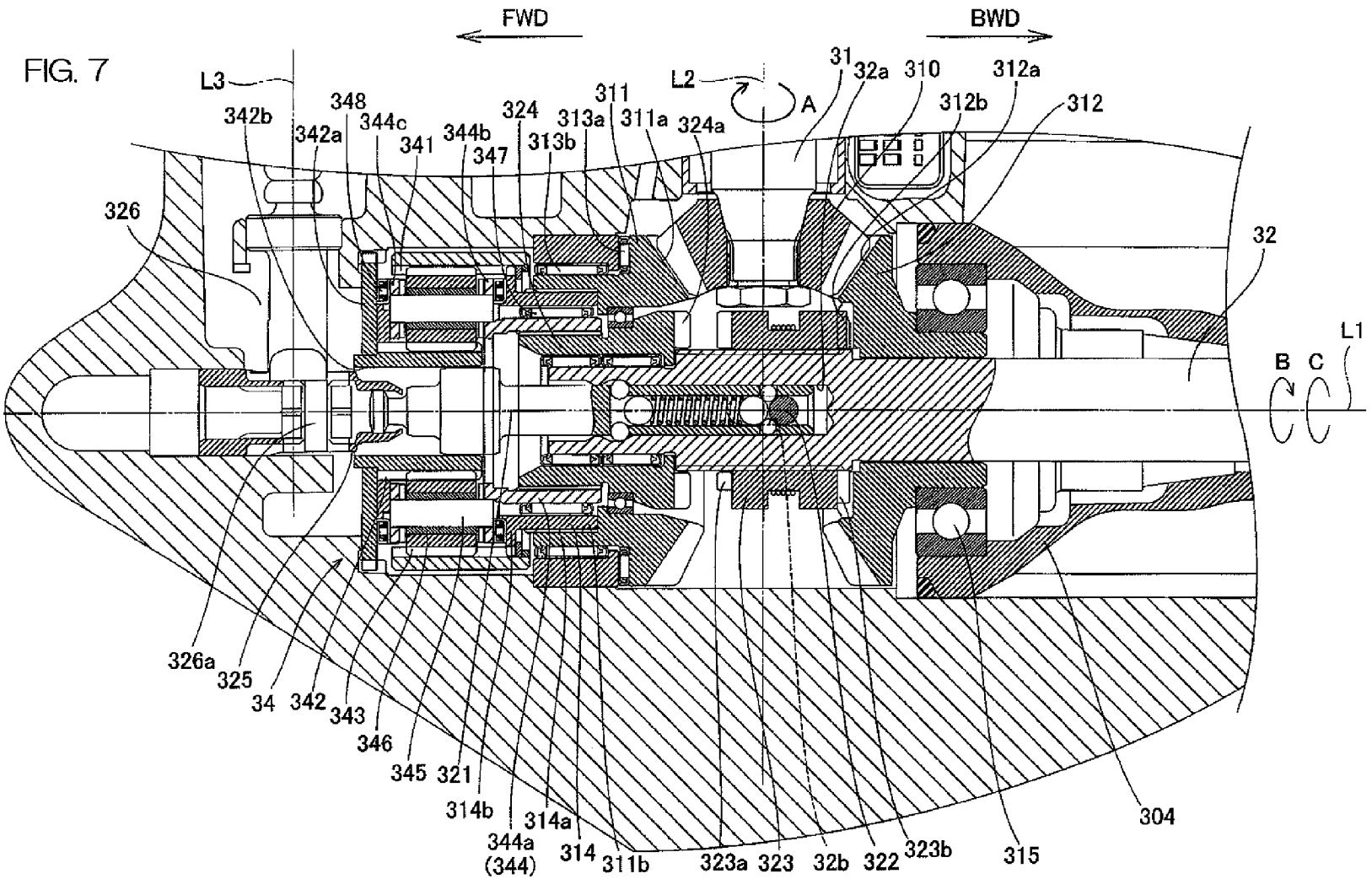
FIG. 7 is a sectional view showing a state of the periphery of the planetary gear mechanism when the hull is driven in reverse by the outboard motor according to a preferred embodiment of the present invention.

FIG. 6 is a sectional view showing a state of the periphery of the planetary gear mechanism 34 when the hull 2 is driven forward by the outboard motor 3 according to a preferred embodiment of the present invention. Also, FIG. 7 is a sectional view showing a state of the periphery of the planetary gear mechanism 34 when the hull 2 is driven in reverse by the outboard motor 3 according to a preferred embodiment of the present invention. A driving force transmission path from the drive shaft 31 to the propeller 33 of the outboard motor 3 shall now be described. First, a driving force transmission path when the hull 2 is driven forward shall be described with reference to FIG. 2, FIG. 5, and FIG. 6.

When the hull 2 is driven forward, the front dog 323*a* of the dog clutch 323 is engaged with the dog portion 324*a* of the first member 324 as shown in FIG. 6. Also, the drive shaft 31 is rotated in the A direction in accordance with the rotation in the A direction of the crankshaft 30*a* of the engine 30. In accordance with the rotation in the A direction of the drive shaft 31, the bevel gear 310 is rotated in the A direction. The front bevel gear 311 is thereby rotated in the B direction, and the rear bevel gear 312 is rotated in the C direction. Then, the rotation in the B direction of the front bevel gear 311 is transmitted to the transmission member 314. The transmission member 314 is thereby rotated in the B direction.

The rotation in the B direction of the transmission member 314 is transmitted from the flange portion 314*b* of the transmission member 314 to the planetary gear mechanism 34. More specifically, the rotation in the B direction of the transmission member 314 is transmitted to the ring gear 341 because the flange portion 314*b* of the transmission member 314 is engaged with the ring gear 341 of the planetary gear mechanism 34. The ring gear 341 is thereby driven in the B direction. Also, in accordance with the rotation of the ring gear 341 in the B direction, the six planetary gears 343 are respectively rotated in the D direction. The six planetary gears 343 are thereby rotated in the E direction about the central rotation axis L1 together with the six axial members 345. A force that rotates the carrier 344 in the B direction is transmitted from the six axial members 345 to the carrier 344 and the carrier 344 is rotated in the B direction.

The rotation in the B direction of the carrier 344 is transmitted to the first member 324 by the engagement of the tubular portion 344*a* of the carrier 344 with the first member 324. The first member 324 is thereby rotated in the B direction. Further, the rotation in the B direction of the first member 324 is transmitted to the dog clutch 323 because the front dog 323*a* of the dog clutch 323 is engaged with the dog portion 324*a* of the first member 324. The dog clutch 323 is thereby rotated in the B direction. The propeller shaft 32 is thus rotated in the B direction together with the dog clutch 323. In accordance with the rotation of the propeller shaft 32 in the B direction, the propeller 33 is rotated in the B direction. A propulsive force that drives the hull 22 forward is thereby generated.

A driving force transmission path when the hull 2 is driven in reverse shall now be described with reference to FIG. 2, FIG. 5, and FIG. 7.

When the hull 2 is driven in reverse, the rear dog 323*b* of the dog clutch 323 is engaged with the dog portion 312*b* of the rear bevel gear 312 as shown in FIG. 7. Also, as mentioned above, the drive shaft 31 is rotated in the A direction in accordance with the rotation in the A direction of the crankshaft 30*a* of the engine 30. Also, in accordance with the rotation in the A direction of the drive shaft 31, the bevel gear 310 is rotated in the A direction. The front bevel gear 311 is thereby rotated in the B direction, and the rear bevel gear 312 is rotated in the C direction. The rotation in the C direction of the rear bevel gear 312 is transmitted to the propeller shaft 32 via the dog clutch 323 because the dog clutch 323 and the rear bevel gear 312 are engaged. The propeller shaft 32 is thereby rotated in the C direction. In accordance with the rotation of the propeller shaft 32 in the C direction, the propeller 33 is rotated in the C direction. A propulsive force that drives the hull 22 in reverse is thereby generated.

Technical effects and merits of the outboard motor according to a preferred embodiment of the present invention shall now be described.

In the present preferred embodiment, when the hull 2 is driven forward, the rotation of the drive shaft 31 is transmitted to the propeller shaft 32 via the planetary gear mechanism 34. More specifically, the rotation from the drive shaft 31 is input into the ring gear 341. Then, the sun gear 342 is fixed in the non-rotating state, and thus the rotation input into the ring gear 341 is output from the carrier 344 via the respective planetary gears 343. The rotation of the drive shaft 31 is thereby transmitted to the propeller shaft 32 via the planetary gear mechanism 34. The planetary gear mechanism 34 decelerates and outputs the input rotation. Further, the planetary gear mechanism 34 amplifies and outputs the input torque. Thus, by the rotation of the drive shaft 31 being transmitted to the propeller shaft 32 via the planetary gear mechanism 34, a large torque is transmitted to the propeller 33. A large torque is thereby transmitted to the propeller 33 during ordinary running of the hull 2 including during the driving of the hull 2 forward at high speed and during increasing of the forward drive speed.

Also, in the present preferred embodiment, the plurality of planetary gears 343 are aligned in a single row so as to surround the sun gear 342. That is, the planetary gear mechanism 34 is a so-called single pinion type planetary gear mechanism. Thus, as compared to a case where the planetary gear mechanism 34 is a so-called double pinion type planetary gear mechanism, enlargement of an outer diameter of the planetary gear mechanism 34 is prevented. More specifically, the enlargement of the outer diameter of the planetary gear mechanism 34 is prevented as compared to a case where the plurality of planetary gears 343 are aligned in two rows so as to surround the sun gear 342. Enlargement of the vicinity of the planetary gear mechanism 34 is thereby prevented.

Also, in the present preferred embodiment, the planetary gear mechanism 34 is arranged such that the rotation input into the ring gear 341 is output from the carrier 344. A speed reduction ratio appropriate for ordinary running of the hull 2 can thus be obtained. More specifically, the so-called single pinion type planetary gear mechanism, arranged such that the rotation input into the ring gear is output from the carrier, has a speed reduction ratio, for example, of not less than approximately 1.20 and not more than approximately 1.80. The speed reduction ratio appropriate for ordinary running of the hull 2 is included in this range. Meanwhile, a so-called single pinion type planetary gear mechanism, arranged such that the rotation input into the sun gear is output from the carrier, has a speed reduction ratio, for example, of not less than approximately 2.25 and not more than approximately 11.00. Thus, in the case where the rotation input into the sun gear is arranged to be output from the carrier, the speed reduction ratio of the planetary gear mechanism is greater than the speed reduction ratio appropriate for ordinary running of the hull 2.

Also, in the present preferred embodiment, the rotation direction of the propeller shaft 32 is switched to the forward drive direction or the reverse drive direction by the changing of the position of the dog clutch 323 in the front/rear direction. Switching between forward drive and reverse drive of the hull 2 can thus be performed readily.

Also, in the present preferred embodiment, the inner peripheral surface of the tubular portion 344*a* of the carrier 344 is spline-engaged with the outer peripheral surface of the first member 324. The carrier 344 and the first member 324 are thus rotated integrally reliably.

Also, in the present preferred embodiment, the transmission member 314 surrounds at least a portion (tubular portion 344*a*) of the carrier 344. Enlargement of the outboard motor 3 as a whole can thereby be prevented.

Also, in the present preferred embodiment, by the engagement of the dog clutch 323 with the rear bevel gear 312, the rotation of the drive shaft 31 is transmitted to the propeller shaft 32 without transmission via the planetary gear mechanism 34. That is, during reverse drive, in which a large torque is not required as compared to during forward drive of the hull 2, the rotation of the drive shaft 31 is transmitted to the propeller shaft 32 without transmission via the planetary gear mechanism 34. A torque of appropriate magnitude is thereby transmitted to the propeller shaft 32.

Also, in the present preferred embodiment, the flange portion 342*a* is provided on the sun gear 342. The flange portion 342*a* is engaged with the lower case 303 at the front relative to the ring gear 341. The sun gear 342 is thereby fixed to the lower case 303 while interference of the sun gear 342 and the ring gear 341 is prevented.

Although, preferred embodiments of the present invention are described above, the present invention is not limited to the contents of the preferred embodiments described above, but can be variously changed within the scope of the claims. For example, with the preferred embodiments, an example where a single outboard motor is attached was described. However, the number of outboard motors may be two or more.

Also, with the preferred embodiments, an example where the marine vessel propulsion unit is an outboard motor was described. However, the marine vessel propulsion unit may be a unit other than an outboard motor. For example, the marine vessel propulsion unit may be a unit of another type, such as an inboard/outboard motor, etc.

Also, with the preferred embodiments, an example where the rotation of the front bevel gear is transmitted to the ring gear via the transmission member was described. However, the outboard motor may be arranged such that the rotation of the front bevel gear is transmitted directly to the ring gear.

Also, with the preferred embodiments, an example where the rotation of the carrier is transmitted to the dog clutch via the first member was described. However, the outboard motor may be arranged such that the rotation of the carrier is transmitted directly to the dog clutch.

Also, with the preferred embodiments, an example where the front bevel gear and the transmission member are preferably spline-engaged mutually was described. However, the joining of the front bevel gear and the transmission member is not restricted to a spline engagement, and the joining may be achieved instead by a pin or a key and a key groove.

The present application corresponds to Japanese Patent Application No. 2009-021531 filed in the Japan Patent Office on Feb. 2, 2009, and the entire disclosure of this application is incorporated herein by reference.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A marine vessel propulsion unit arranged to apply a propulsive force to a hull, the marine vessel propulsion unit comprising:

an engine;

a drive shaft arranged to extend vertically;

a propeller shaft arranged to extend in a direction intersecting the drive shaft and arranged such that a rotation of the engine is transmitted to the propeller shaft via the drive shaft;

a propeller arranged to rotate together with the propeller shaft;

a planetary gear mechanism arranged toward a front of the marine vessel propulsion unit relative to the drive shaft and coaxial to a central rotation axis of the propeller shaft and arranged to decelerate a rotation from the drive shaft and transmit a decelerated rotation toward the propeller shaft when the hull is driven forward; and a housing arranged to house the planetary gear mechanism; wherein the planetary gear mechanism includes a sun gear fixed to the housing in a non-rotating state with respect to the housing, a ring gear into which the rotation from the drive shaft is input, a plurality of planetary gears arranged between the sun gear and the ring gear, and a carrier arranged to hold the plurality of planetary gears, and the planetary gear mechanism is arranged such that a rotation of the carrier is output to the propeller shaft.

2. The marine vessel propulsion unit according to claim 1, wherein the plurality of planetary gears are aligned in a single row around the sun gear such that each of the planetary gears is engaged with both the ring gear and the sun gear.

3. The marine vessel propulsion unit according to claim 1, further comprising a clutch arranged to switch a rotation direction of the propeller shaft to a forward drive direction or a reverse drive direction, and arranged to transmit the rotation of the carrier to the propeller shaft when the hull is driven forward.

4. The marine vessel propulsion unit according to claim 3, wherein the clutch includes a first member arranged to rotate together with the carrier, and a second member arranged to rotate together with the propeller shaft and arranged to selectively transmit a rotation of the first member to the propeller shaft.

5. A marine vessel propulsion unit arranged to apply a propulsive force to a hull, the marine vessel propulsion unit comprising:

an engine;

a drive shaft arranged to extend vertically;

a propeller shaft arranged to extend in a direction intersecting the drive shaft and arranged such that a rotation of the engine is transmitted to the propeller shaft via the drive shaft;

a propeller arranged to rotate together with the propeller shaft; and a planetary gear mechanism arranged toward a front of the marine vessel propulsion unit relative to the drive shaft and coaxial to a central rotation axis of the propeller shaft and arranged to decelerate a rotation from the drive shaft and transmit a decelerated rotation toward the propeller shaft when the hull is driven forward; wherein the planetary gear mechanism includes a sun gear fixed in a non-rotating state, a ring gear into which the rotation from the drive shaft is input, a plurality of planetary gears arranged between the sun gear and the ring gear, and a carrier arranged to hold the plurality of planetary gears, and the planetary gear mechanism is arranged such that a rotation of the carrier is output to the propeller shaft;

the marine vessel propulsion unit further comprises a clutch arranged to switch a rotation direction of the propeller shaft to a forward drive direction or a reverse drive direction, and arranged to transmit the rotation of the carrier to the propeller shaft when the hull is driven forward;

the clutch includes a first member arranged to rotate together with the carrier, and a second member arranged to rotate together with the propeller shaft and arranged to selectively transmit a rotation of the first member to the propeller shaft; and the carrier includes a tubular portion including an inner peripheral surface that engages with an outer peripheral surface of the first member, and the carrier is arranged to rotate together with the first member by an engagement of the outer peripheral surface of the first member with the inner peripheral surface of the tubular portion.

6. A marine vessel propulsion unit arranged to apply a propulsive force to a hull, the marine vessel propulsion unit comprising:

an engine;

a drive shaft arranged to extend vertically;

a propeller shaft arranged to extend in a direction intersecting the drive shaft and arranged such that a rotation of the engine is transmitted to the propeller shaft via the drive shaft;

a propeller arranged to rotate together with the propeller shaft; and a planetary gear mechanism arranged toward a front of the marine vessel propulsion unit relative to the drive shaft and coaxial to a central rotation axis of the propeller shaft and arranged to decelerate a rotation from the drive shaft and transmit a decelerated rotation toward the propeller shaft when the hull is driven forward; wherein the planetary gear mechanism includes a sun gear fixed in a non-rotating state, a ring gear into which the rotation from the drive shaft is input, a plurality of planetary gears arranged between the sun gear and the ring gear, and a carrier arranged to hold the plurality of planetary gears, and the planetary gear mechanism is arranged such that a rotation of the carrier is output to the propeller shaft; and the marine vessel propulsion unit further comprises a reduction mechanism arranged to decelerate a rotation from the drive shaft and transmit a decelerated rotation to the ring gear, wherein the reduction mechanism includes:

an output gear arranged to rotate together with the drive shaft;

a first bevel gear engaged with the output gear and arranged to rotate in a first direction about the central rotation axis of the propeller shaft; and a transmission member arranged to rotate together with the first bevel gear and arranged to transmit a rotation of the first bevel gear to the ring gear.

7. The marine vessel propulsion unit according to claim 6, wherein the transmission member is arranged to surround at least a portion of the carrier.

8. The marine vessel propulsion unit according to claim 1, wherein the sun gear is provided toward the front of the marine vessel propulsion unit relative to the ring gear and includes a flange portion arranged to engage with the housing.

9. The marine vessel propulsion unit according to claim 1, further comprising an upper case that houses the drive shaft, wherein the housing is disposed below the upper case and houses the propeller shaft and the planetary gear mechanism.

10. The marine vessel propulsion unit according to claim 6, further comprising a clutch arranged to switch a rotation direction of the propeller shaft to a forward drive direction or a reverse drive direction, and arranged to transmit the rotation of the carrier to the propeller shaft when the hull is driven forward.

11. The marine vessel propulsion unit according to claim 10, wherein the reduction mechanism further includes:

a second bevel gear engaged with the output gear and arranged to rotate about the central rotation axis of the propeller shaft in a second direction, which is an opposite direction with respect to the first direction; and the clutch is arranged to be connected to the second bevel gear to cause the propeller shaft to rotate in the reverse drive direction.

12. A marine vessel propulsion unit arranged to apply a propulsive force to a hull, the marine vessel propulsion unit comprising:

an engine;

a drive shaft arranged to extend vertically;

a propeller shaft arranged to extend in a direction intersecting the drive shaft and arranged such that a rotation of the engine is transmitted to the propeller shaft via the drive shaft;

a propeller arranged to rotate together with the propeller shaft; and a planetary gear mechanism arranged toward a front of the marine vessel propulsion unit relative to the drive shaft and coaxial to a central rotation axis of the propeller shaft and arranged to decelerate a rotation from the drive shaft and transmit a decelerated rotation toward the propeller shaft when the hull is driven forward; wherein the planetary gear mechanism includes a sun gear fixed in a non-rotating state, a ring gear into which the rotation from the drive shaft is input, a plurality of planetary gears arranged between the sun gear and the ring gear, and a carrier arranged to hold the plurality of planetary gears, and the planetary gear mechanism is arranged such that a rotation of the carrier is output to the propeller shaft; and the marine vessel propulsion unit further comprises a reduction mechanism arranged to decelerate a rotation from the drive shaft and transmit a decelerated rotation to the ring gear, wherein the reduction mechanism includes:

an output gear arranged to rotate together with the drive shaft; and a first bevel gear engaged with the output gear and arranged to rotate in a first direction about the central rotation axis of the propeller shaft, a rotation of the first bevel gear being transmitted to the ring gear.

13. The marine vessel propulsion unit according to claim 12, further comprising a clutch arranged to switch a rotation direction of the propeller shaft to a forward drive direction or a reverse drive direction, and arranged to transmit the rotation of the carrier to the propeller shaft when the hull is driven forward.

14. The marine vessel propulsion unit according to claim 13, wherein the reduction mechanism further includes a second bevel gear engaged with the output gear and arranged to rotate about the central rotation axis of the propeller shaft in a second direction, which is an opposite direction with respect to the first direction; and the clutch is arranged to be connected to the second bevel gear to cause the propeller shaft to rotate in the reverse drive direction.

* * * * *